US006848341B2

(12) United States Patent
Pace et al.

(10) Patent No.: US 6,848,341 B2
(45) Date of Patent: Feb. 1, 2005

(54) ROCK HAMMER

(75) Inventors: Randy Eugene Pace, Wellford, SC (US); Joshua Michael Runion, Taylors, SC (US)

(73) Assignee: Artistic View, Inc., Lyman, SC (US)

( * ) Notice: Subject to any disclaimer, the term of this patent is extended or adjusted under 35 U.S.C. 154(b) by 55 days.

(21) Appl. No.: 10/271,854

(22) Filed: Oct. 16, 2002

(65) Prior Publication Data

US 2004/0074342 A1 Apr. 22, 2004

(51) Int. Cl.[7] ..... B25D 1/00
(52) U.S. Cl. ..... 81/22; 81/20
(58) Field of Search ..... 81/20–26; 7/143, 7/146; D8/75

(56) References Cited

U.S. PATENT DOCUMENTS 1,356,673 A * 10/1920 Vaughan ..... 81/20
1,362,797 A * 12/1920 Hose ..... 7/146
2,627,078 A * 2/1953 Eliot ..... 7/138
2,731,993 A * 1/1956 Mount ..... 81/24
2,755,833 A * 7/1956 Quayle ..... 81/19
4,139,237 A 2/1979 Hay
4,216,808 A * 8/1980 Royce ..... 81/20
4,363,344 A * 12/1982 Pollak ..... 81/20
5,002,257 A 3/1991 Evans
5,408,902 A * 4/1995 Burnett ..... 81/22
6,202,511 B1 3/2001 Murray et al.

FOREIGN PATENT DOCUMENTS

JP 2001343369 A * 12/2001 ..... G01N/29/12
JP 2002219666 A * 8/2002 ..... B25D/1/00

* cited by examiner

*Primary Examiner*—David B. Thomas
(74) *Attorney, Agent, or Firm*—J.Bennett Mullinax, LLC

(57) ABSTRACT

A hammer useful for working rock, stone, and other hardened substrates is provided. The hammer head defines an acoustic chamber which resonates tones when the hammer is used to strike an object. Variations in the tones alert the user to changes in the rock substrate. Optionally, a pin extends from a striking surface of the hammer and extends part way into the acoustic chamber.

16 Claims, 2 Drawing Sheets

ROCK HAMMER

FIELD OF THE INVENTION

This invention is directed towards a hammer which can be used for breaking and shaping rock, stone, brick, cinderblock, concrete, artificial stone, and similar materials.

BACKGROUND OF THE INVENTION

This invention relates to hammers used in the brick and rock-working industry. Workers in the brick, rock, and stone-working industries frequently use a brick hammer for breaking and shaping construction materials. A conventional brick hammer, such as one seen in U.S. Pat. No. 5,002,257, and which is incorporated herein by reference, provides for an enlarged and relatively heavy head with a relatively flat face used to strike a brick or other similar building material. Opposite the head, the hammer defines a rear terminus having a cutting edge which can be used to score a brick or to provide a sharp cutting edge.

Conventional brick hammers are made of a relatively soft steel which may be easily cast into a desired shape. The softness of the steel provides adequate strength for the purpose of shaping bricks and concrete blocks. However, when brick hammers are used in the working of rock and natural stone, the soft steel quickly wears and greatly shortens the useful life of the hammer. Further, the face of the brick hammer tends to wear unevenly when working rock. The uneven wear is a result of a user's dominant hand which creates a wear pattern on the hammer's face. As the face of the hammer slopes as a result of the uneven wear, the hammer is unable to provide accurate and effective blows, particularly when used on harder materials such as rock or stone.

The soft steel used in the construction of a typical brick hammer also causes the sharp cutting edge to rapidly wear away when used on rock and natural stone. As a result, the soft steel used in a conventional brick hammer brings about a rapid loss of the desirable shape and features of the hammer.

Traditionally, workers of rock and natural stone have relied upon commercially available brick hammers as their primary stone working tool. Heretofore, there has not been a rock hammer specifically designed for use with rock and natural stone. Accordingly, there is room for improvement and variation within the art of hammers useful for working rock, brick, and masonry.

SUMMARY OF THE INVENTION

It is one aspect of at least one of the present embodiments of the invention to provide a hammer having a construction and design specific for working rock and other hard stone and stone-like substrates.

It is yet another aspect of at least one of the embodiments of the present invention to provide a chamber or cavity positioned within a hammer head wherein the chamber emits sound tones which vary depending upon the striking force of the hammer and the nature of the substrate struck by the hammer.

It is yet another aspect of at least one of the present embodiments of the invention to provide a rock hammer in which the hammer head defines a chamber extending through at least one edge wall of the hammer head, the chamber positioned behind and in proximity to the striking surface of the hammer the chamber generating sounds upon the hammer head striking against an object, the tone of the sounds varying depending upon the make up of the struck object.

It is yet another aspect of at least one of the present embodiments of the invention to provide a hammer having a pin, the pin having a first end which extends from the striking surface of the hammer and a second end extending into a chamber defined by the head of the hammer. The pin provides improved transmission of vibrations within the chamber, increasing the quality and intensity of the sound tones generated by the hammer.

It is yet another aspect of at least one of the embodiments of the present invention to provide a rock hammer in which the head and handle are milled from a single piece of steel such as a 4140 steel and which is subsequently heat hardened.

It is yet another aspect of at least one of the present embodiments of the invention to provide a rock hammer in which the head additionally defines a tapered blade at an end opposite the striking surface.

It is yet another aspect of at least one of the present embodiments of the invention to provide a hammer having a blade portion which defines a series of spaced scores, the scores being parallel to the blade edge.

It is yet another aspect of at least one of the present embodiments of the invention to provide a rock hammer in which the handle defines a ballbearing contained within a handle cavity, the ball bearing facilitating the absorption of vibrations.

It is yet another aspect of at least one of the present embodiments of the invention to provide a rock hammer having a handle, the handle defining an axial bore extending from a bottom of the handle and which extends upwardly a distance of at least about 2 inches and preferably at least about 2-½ to 3 inches and still more preferably the bore defining a reduced diameter taper as the bore extends axially into the handle.

It is still an additional aspect of at least one of the present embodiments of the invention to provide a rock hammer having a handle, the handle defining a bore extending transversely from a first edge of the handle to a second edge of the handle, the bore optionally defining a tapered bore, the bore diameter increasing as the bore approaches the respective edge of the handle.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Figure 1:
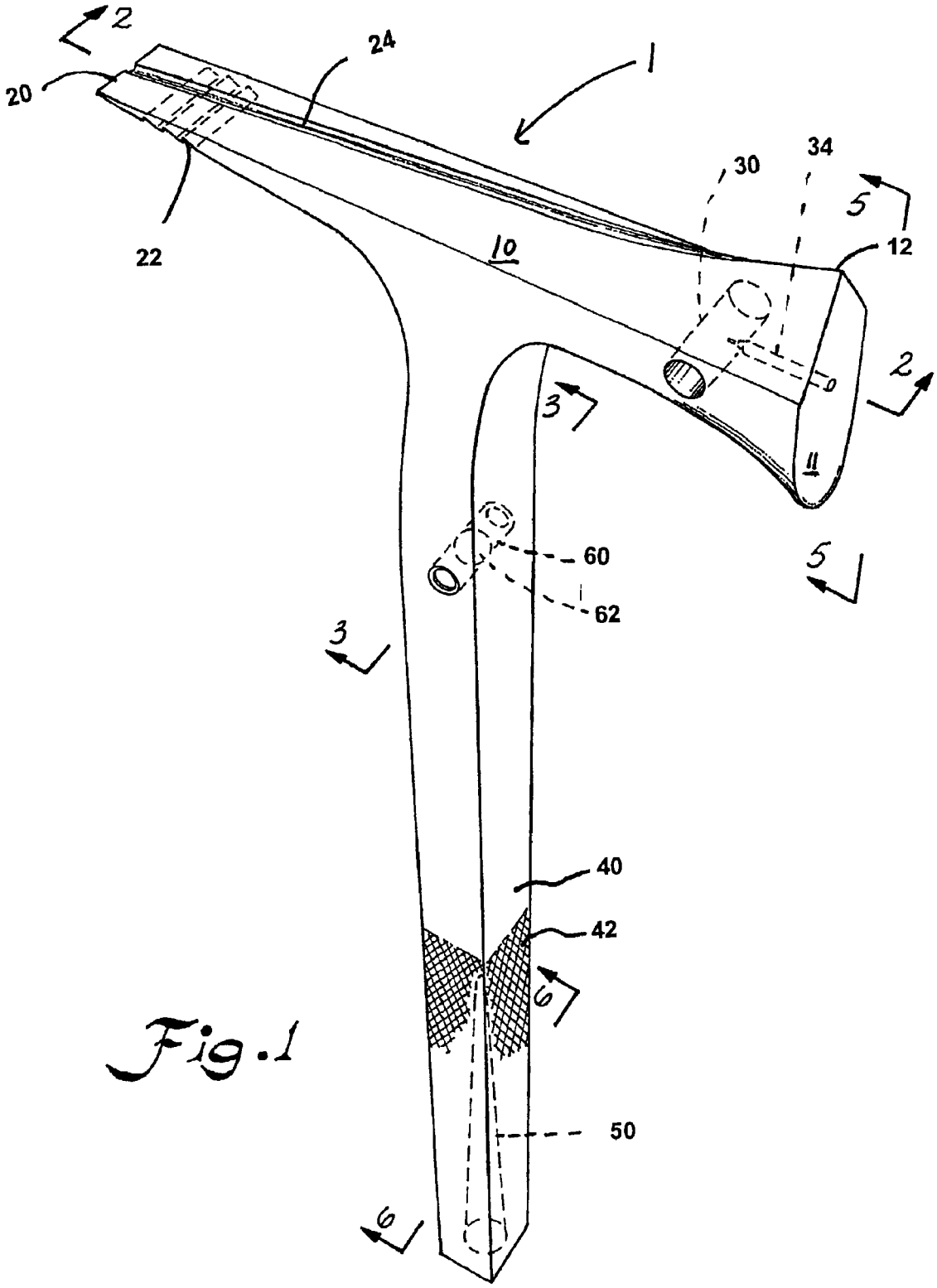
FIG. 1 is a side perspective view of a rock hammer according to one of the present inventions.
Figure 2:
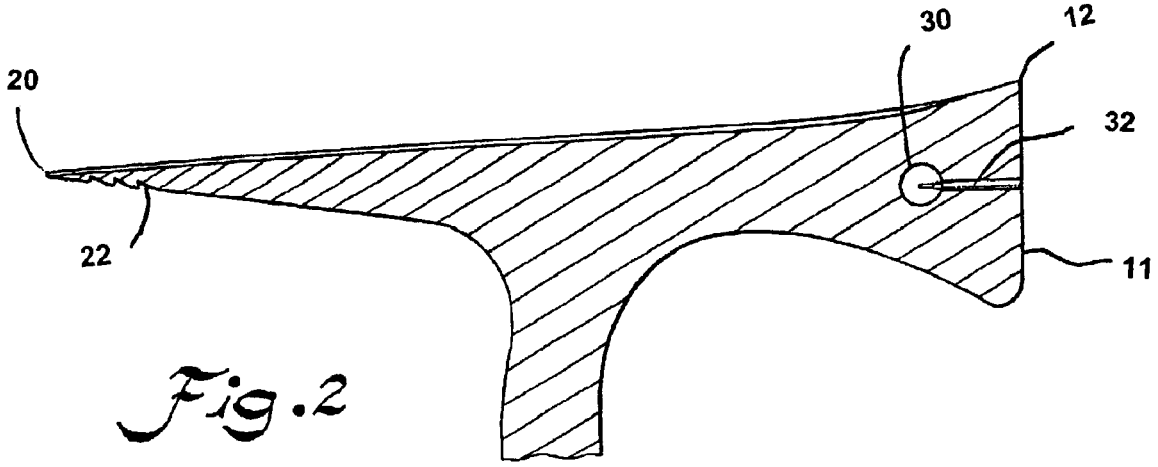
FIG. 2 is a sectional view taken along line 2—2 of the rock hammer seen in FIG. 1.
Figure 3:
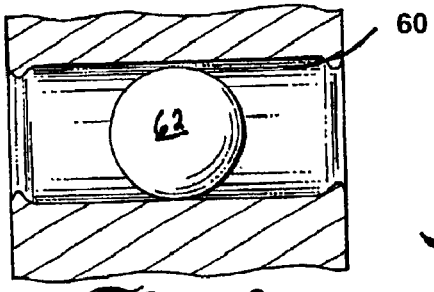
FIG. 3 is a sectional view of the rock hammer taken along line 3—3 of FIG. 1.
Figure 5:
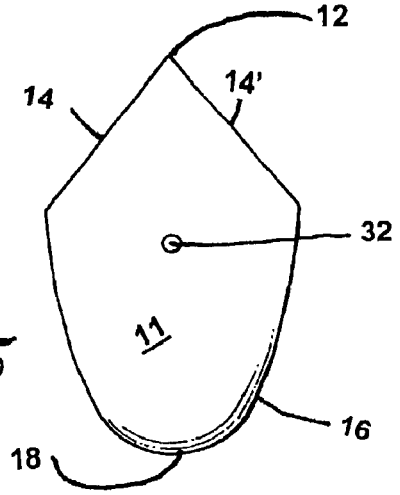
FIG. 5 is a plan view of a striking face of the rock hammer seen in the direction of line 5—5 in FIG. 1.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

As seen in reference to FIGS. 1 through 6, a hammer 1 is provided having a hammer head 10 which defines a flat striking surface 11 on a front end of the hammer. The hammer head 10, as best seen in reference to FIG. 1, defines an upper ridge 12 formed along a top portion of the hammer head, a portion of ridge 12 being coextensive with the strike face 11. The perimeter of strike face 11 is further defined by a pair of straight edge walls 14 and 14', (FIG. 5) edge walls 14 and 14' forming an approximate right angle with each other at a point of intersection with the coextensive portion of ridge 12.

A respective free end of edge walls 14 and 14' intersect with a "U"-shaped edge wall 16, edge wall 16 (FIG. 5) defining a chin 18 along the lower edge of the strike face and opposite upper ridge 12. In the illustrated embodiment best seen in FIGS. 1 and 5, the strike face surface 11 has a width of about 1 inch and a height of about 1.5 inches.

The second end of the hammer head 10 defines a blade 20 along a back surface of the hammer head. Adjacent the blade 20, the lower surface of the hammer head defines a plurality of serrations 22, each individual serration being parallel to the edge of blade 20. A groove 24 is defined along at least a portion of the top surface of the hammer head. In the illustrated embodiment, the groove extends from a region immediately adjacent upper ridge 12, along the midpoint of the top surface and extends along the top surface to a rear of the hammer head. The groove provides a sighting mechanism for the user of the hammer.

The second end of the hammer may take the form of various useful shapes. For instance, the rear terminus of the hammer head may define a pick or other point-like projection. If desired, the terminal point may be in the form of a "V"-type structure in which the edge walls defining the "V" can be in the form of a blade. In such an embodiment, the serrations would also be in a "V"-shaped pattern, the serrations being parallel to a respective blade portion of the hammer.

The serrations 22 along the rear of the hammer head allow the desired blade 20 or point to be re-established when the initial surface is worn. The serrations allow the blade to be re-established either through natural wearing along the serration lines or by cutting or breaking the hammer head along the serrated margins to re-establish the blade shape.

The hammer head 10 additionally defines a chamber 30, chamber 30 preferably being positioned between a midsegment of the hammer head and the strike face 11. At least one, and optionally both edge walls of the hammer head define a wall opening which is in communication with the chamber 30. Chamber 30 is in further communication with a bore 34 which extends axially from a chamber wall to the strike face 11. Bore 34 is adapted for receiving a metal pin 32, (FIG. 2) one end of pin 32 being substantially flush with the strike face 11 and a free end of the pin projecting into the chamber interior. As seen in reference to FIGS. 1 and 2, the free end of pin 32 may define a tapered point. Pin 32 transmits vibrations from the strike face into the chamber 30, the vibrations from the pin resonating from the chamber to provide an audible tone. In accordance with the present invention, it has been found that the tone quality (pitch, intensity, clarity) varies depending upon the hardness of the material being struck by the hammer. The changes in tone quality alert the user to non-visible changes or quality of the rock being worked.

For instance, once an internal, non-visible crack or fissure is developed in the rock work surface, this change in the substrate results in the hammer tone qualities being altered. As a result, the user is aware that the rock substrate has become weakened and can lessen the severity of the succeeding blows. As a result, the final fracture of the rock can be done with reduced strength hammer blows, thereby reducing the likelihood of the rock being further fractured into smaller pieces or undesired shapes.

While the chamber 30 defined within head 10 provides an audible indication as to the structural integrity of the material being worked, it has been found that the inclusion of pin 32 which extends into the chamber 30 brings about improvements in the quality of tones generated by the hammer. While a single pin is illustrated, it is envisioned that more than one pin may be used including a pair of aligned, spaced pins which may resonate tones similar to a tuning fork.

Pin 32 may be removed and replaced as needed. While the illustrated embodiment indicates one end of the pin is substantially flush with the strike face surface 11, it is not a requirement that the pin extend the entire distance from the bore to the strike face. For instance, the pin could be inserted into the chamber and through the bore, the bore extending only part way toward the face of the hammer.

Chamber 30 may be in the form of a circular bore as seen in FIG. 1 which extends through opposite edge walls of the hammer head. Such a configuration will release sounds in two directions, each direction on an opposite sidewall of the hammer head. Chamber 30 may be of a variety of shapes and sizes. The dimensions, shape, and placement of the chamber 30 within the hammer head 10 may be varied so as to achieve desired tonal qualities which reasonate from chamber 30 when the hammer is used to strike a surface.

Figure 4:
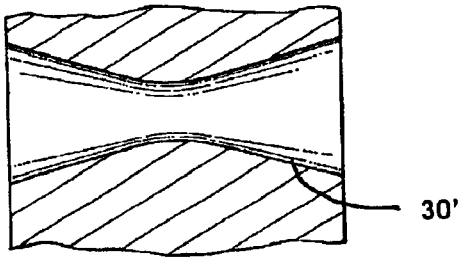
FIG. 4 is an alternative shape of an acoustic chamber defined within the hammer head.
Figure 6:
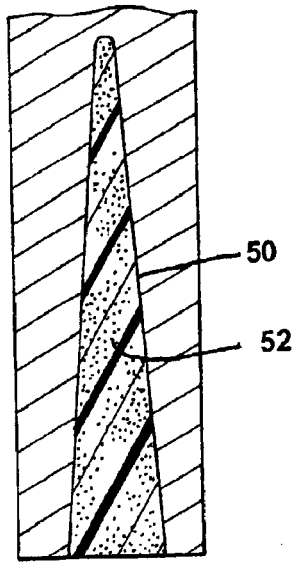
FIG. 6 is a sectional view of the handle taken along line 6—6 of FIG. 1.

One alternative embodiment of the chamber may be seen in reference to FIG. 4 where chamber 30' is defined through two edge walls of the hammer head. As best seen in reference to FIG. 4, the chamber shape may be in the form of two inverted cones, the larger diameter ends of each cone being defined through a respective edge wall of the hammer head. As seen in FIG. 4, the edges of the hammer head which define the acoustic chamber 30' may include opposite edges of the hammer head. While not separately illustrated, it is understood that a pin 32 could have one end extending into the interior acoustic chamber 30', the pin 32 transmitting vibrations into the chamber as described above in reference to chamber 30.

The base of the hammer head 10 forms a neck which merges into a handle 40. Handle 40 may have a conventional grip 42 made from leather, plastic, or suitable composite material to increase the user comfort. A base of the handle defines an axial bore 50 which extends a distance of at least about 2 inches. As seen in reference to FIG. 6, the axial bore 50 is illustrated as having a reduced diameter taper as the bore extends into the handle. However, the bore may also be formed having a substantially uniform diameter. Optionally, as seen in reference to FIG. 6, the cavity may be filled with a vibration absorbing material 52 such as a structural foam or an insert made of wood, fiberglass, or plastic. The axial bore 50 and any optional insert helps to dissipate vibrations. Further, the bore may also be used and varied in size to decrease the overall weight of the hammer and/or to achieve a better balance to the hammer. It is also envisioned that a series of apertures may be drilled into various portions of the handle 40, the apertures being placed strategically to bring about a balanced hammer as well as to achieve a lighter weight hammer.

Optionally, handle 40 may define one or more internal cavities 60, in which each cavity 60 may take the form of a variety of shapes and have set therein a ball bearing 62. The ball bearing 62 may be provided of any suitable material, including steel, titanium, or other metals, and helps in the absorption of vibrations transmitted from the hammer head to the handle. While not separately set forth in the drawings, a welded cap or other closure is applied along the edge wall of the hammer adjacent opening(s) to chamber 60 to retain ball bearing 62 therein.

The hammer 1 may be milled using water jets from a single piece of 4140 steel. Following the milling of the hammer, bores 34 and 50, chamber 30, and cavity 60 may be formed using additional water jetting and/or conventional drills. Following the establishment of the respective bores, the hammer is fire hardened as is conventional for 4140 steel articles. The fire hardening strengthens the steel and increases the hardness and resistance to wear.

Following the firing of the hammer, pin 32 may be inserted into chamber 30 or 30'. Pin 32 may be removed and replaced as needed. However, it is envisioned that a suitable pin may also be provided prior to the firing of the hammer.

The rock hammer according to the present invention offers substantial improvements over conventionally available hammers. The resulting hammer is more durable than a conventional brick hammer. Being more durable, the hammer provides an improved, longer wearing strike face which maintains a desired shape and performance of the hammer. The inclusion of the chamber also increases the utility of the hammer. The nature and quality of the sounds and tones emitted by the hammer provides the worker with useful information regarding the rock substrate. As such, the worker can adjust the intensity of hammer strikes and/or vary the location of subsequent hammer blows in response to the tonal signal changes in the rock substrate.

The usefulness of the hammer is not limited solely to rock. Additional features may be found in the hammer such as the blade 20 which is useful for scoring and breaking bricks. The face of the hammer is also adapted for working brick as well as shaping rock and other, similar building materials. For instance, the point defined along ridge 12 may be used to direct the impact of the hammer on a small, localized point. This ability is useful not only in working brick, but in working other natural and synthetic stone substrates. The chin 18 is also useful for deburring and smoothing a rock surface to remove points or to otherwise shape the substrate. The edge walls 14 and 14' may also be used to strike the rock or other substrate. The impact using an edge wall delivers the blow along a straight edge face and is useful in breaking and shaping a substrate. The strike face of the illustrated embodiment further provides a ridge 12, a substantially planar strike face 11, a series of straight edge walls 14 and 14', as well as curved chin 18. All of these various surfaces can be used without having to invert the hammer or otherwise break the rhythm of the user. Accordingly, the present invention offers a versatile, durable hammer which provides the user a level of information and feedback not heretofore available.

While it is envisioned that a preferred embodiment of the hammer be constructed of a single piece of hardened metal, many of the useful attributes of the hammer design could be provided by a separate hammer head and handle combination. Such a combination is not believed to be as useful in that the overall hammer is structurally weaker. However, many of the features and advantages of the present hammer would be available for a hammer provided from a separate hammer head and a separate handle.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A hammer comprising:

a head having a striking surface on one end;

a handle engaging the head;

a chamber, defined by the head, the chamber having at least one opening extending through at least one edge wall of the head; and, a pin, a first terminus of the pin positioned within the chamber and a second terminus of the pin substantially coplanar with a plane defined by the striking surface of the hammer.

2. The hammer according to claim 1 wherein the head and the handle are milled from a single piece of steel.

3. The hammer according to claim 2 wherein the steel is a 4140 steel.

4. The hammer according to claim 1 wherein a bore is defined by said head said bore extending from said chamber to said striking surface, a portion of said pin being carried within said bore.

5. The hammer according to claim 1 wherein the head further defines a blade at an end opposite the striking surface.

6. The hammer according to claim 5, wherein the head, adjacent the blade, further defines a series of spaced grooves, said grooves parallel to an edge of the blade.

7. The hammer according to claim 1 wherein the handle further defines a ball-bearing, the ball-bearing being housed within a cavity defined by said handle.

8. The hammer according to claim 1 wherein the handle further defines an axial bore, the axial bore extending from a bottom of the handle a distance of at least about 2 inches.

9. The hammer according to claim 8 wherein the axial bore is tapered.

10. The hammer according to claim 1 wherein a top surface of the head defines a groove extending substantially lengthwise along the head.

11. The hammer according to claim 1 wherein the first terminus of the pin defines a tapered point.

12. A hammer comprising:

a head having a striking surface on one end;

a handle engaging the head; and, a chamber, defined by the head, the chamber extending through opposite sides of the head the chamber further defining a mid-section having a first diameter, the diameter of the chamber increasing as the chamber extends to respective opposite sides of the head.

13. The hammer according to claim 12 wherein the head further defines a pin, a first terminus of the pin positioned within the chamber and a second terminus of the pin substantially co-planar with a plane defined by an exterior of said striking surface.

14. A hammer head comprising:

an integral mass defining a striking surface on a first end; and, an acoustic chamber, defined by said integral mass, said acoustic chamber having at least one opening extending through at least one edge wall of said integral mass, said acoustic chamber defining a pin projecting into said acoustic chamber from at least one edge wall of said integral mass wherein said acoustic chamber resonates sounds, said sounds varying depending upon the nature of a substrate struck by said striking surface.

15. A hammer head according to claim 14 wherein said chamber is adjacent said striking surface.

16. The hammer head according to claim 14 wherein a first terminus of said pin is positioned within the acoustic chamber and a second terminus of said pin is positioned in proximity to and substantially co-planar with a plane defined by an exterior of said striking surface.

* * * * *